US005955711A

United States Patent [19]

Butala et al.

[11] Patent Number: 5,955,711

[45] Date of Patent: Sep. 21, 1999

[54] IGNITION SWITCH WITH SEGMENTED ROTARY ACTUATION FOR CONSTRAINED PACKAGING ENVIRONMENT

[75] Inventors: Peter P. Butala, White Lake; Michael J. Pontieri, Clinton Township, both of Mich.

[73] Assignee: ITT Manufacturing Enterprises, Inc., Wilmington, Del.

[21] Appl. No.: 09/052,449

[22] Filed: Mar. 31, 1998

[51] Int. Cl.[6] ..... H01H 19/00

[52] U.S. Cl. ..... 200/6 BB; 200/6 B

[58] Field of Search ..... 200/43.01, 43.03, 200/43.04, 43.08, 43.11, 61.91, 11 R, 11 A, 11 J, 6 B, 6 BB, 6 BA, 336, 573, 6 R, 175, 176, 178, 179, 283, 284, 568, 569; 29/622

[56] References Cited

U.S. PATENT DOCUMENTS

| | | | |
|---|---|---|---|
| 3,097,269 | 7/1963 | Campbell | 200/16 |
| 3,211,874 | 10/1965 | Bengtsson | 200/166 |
| 3,271,531 | 9/1966 | Winogrocki | 200/6 |
| 3,293,399 | 12/1966 | Heinrich | 200/166 |
| 3,319,016 | 5/1967 | Hoy | 200/16 |
| 3,339,032 | 8/1967 | Hults | 200/16 |
| 3,500,389 | 3/1970 | Robinson | 340/364 |
| 3,719,788 | 3/1973 | Holland | 200/153 LB |
| 3,903,383 | 9/1975 | Marker | 200/11 TW |
| 3,971,904 | 7/1976 | Ward | 200/6 BB |
| 4,042,795 | 8/1977 | Sykora | 200/16 D |
| 4,204,098 | 5/1980 | Strande | 200/1 R |
| 4,563,551 | 1/1986 | Black | 200/16 C |
| 4,616,112 | 10/1986 | Galloway | 200/5 R |
| 4,751,352 | 6/1988 | Botz | 200/6 BB |
| 4,766,272 | 8/1988 | Guzzon | 200/302.2 |
| 4,868,352 | 9/1989 | Botz | 200/4 |
| 5,049,706 | 9/1991 | DuRocher | 200/61.54 |
| 5,182,422 | 1/1993 | Botz | 200/61.54 |
| 5,182,423 | 1/1993 | Botz | 200/61.54 |
| 5,196,662 | 3/1993 | Hofmann | 200/61.54 |
| 5,237,133 | 8/1993 | Frank | 200/11 C |
| 5,259,262 | 11/1993 | DuRocher | 74/462 |
| 5,374,777 | 12/1994 | Hofmann | 174/50 |
| 5,596,180 | 1/1997 | Hofmann | 200/6 B |

FOREIGN PATENT DOCUMENTS

| | | |
|---|---|---|
| 87944 | 10/1959 | Denmark . |
| 2533802 | 7/1975 | Germany . |
| 3219579 | 12/1982 | Germany . |
| 3237055 | 4/1983 | Germany . |
| 42 33 520 | 1/1994 | Germany . |
| 610395 | 10/1960 | Italy . |

*Primary Examiner*—Michael L. Gellner
*Assistant Examiner*—Nhung Nguyen
*Attorney, Agent, or Firm*—J. Gordon Lewis

[57] ABSTRACT

An electrical switch selectively controls an ignition circuit and accessory circuits of a motor vehicle. The electrical switch includes a segmented rotatable member with radially extending side walls having cam surfaces formed thereon for operably actuating electrically conductive leaf spring members to individually open and close electrical circuits in response to positioning the rotatable member in predefined angular positions. A segmented, asymmetrical rotary actuator and housing assembly permits placement of the switch in close proximity to other system components.

22 Claims, 8 Drawing Sheets

FIG 3
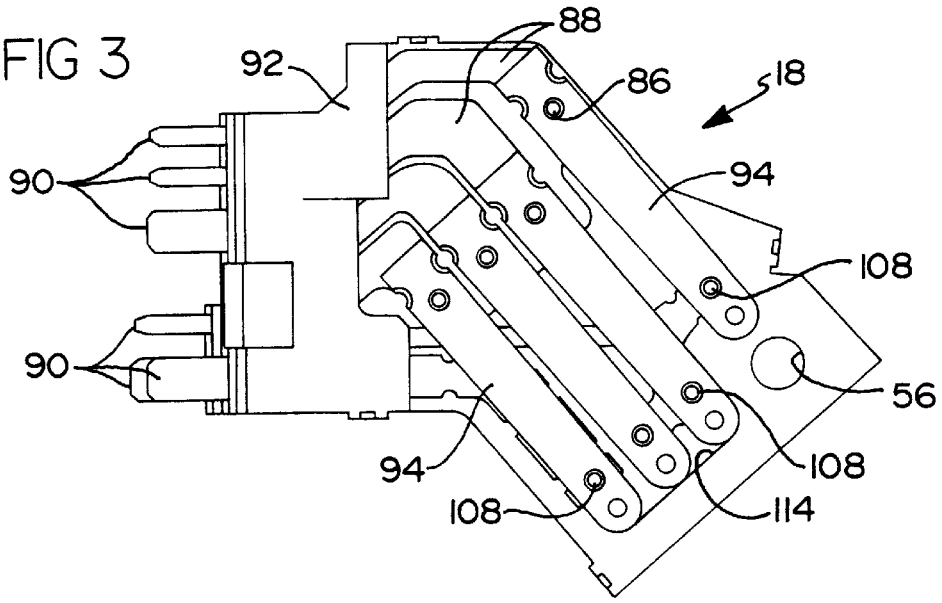
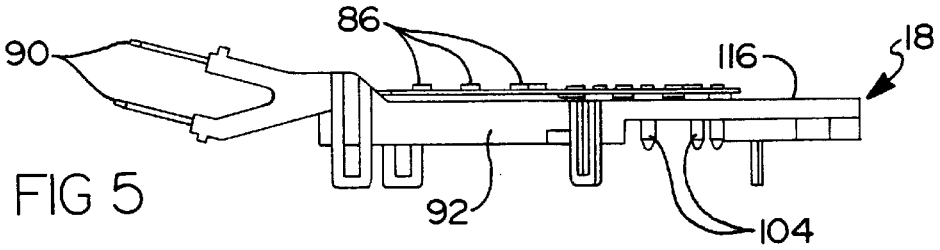
FIG 5
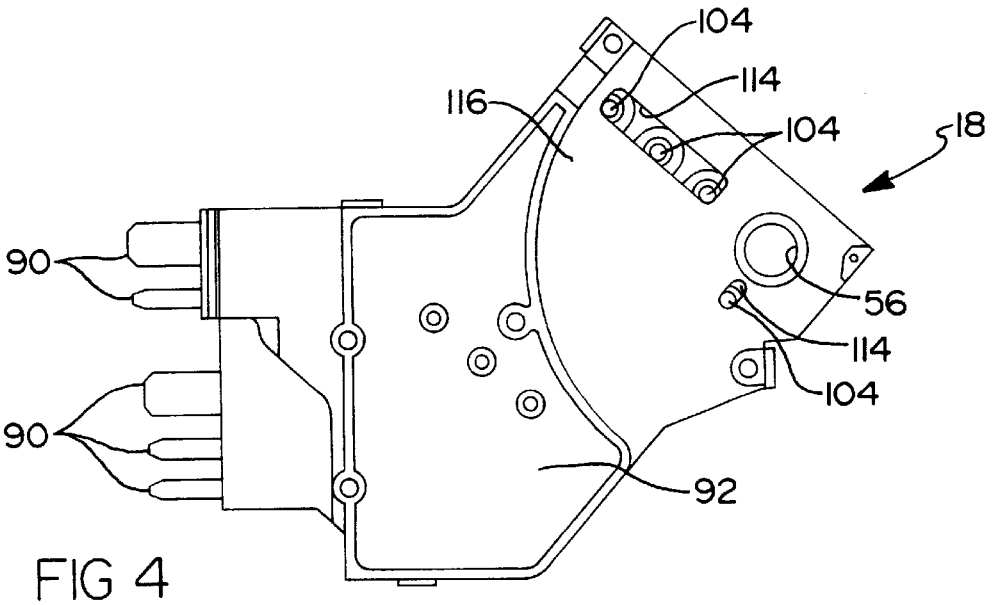
FIG 4

FIG 17
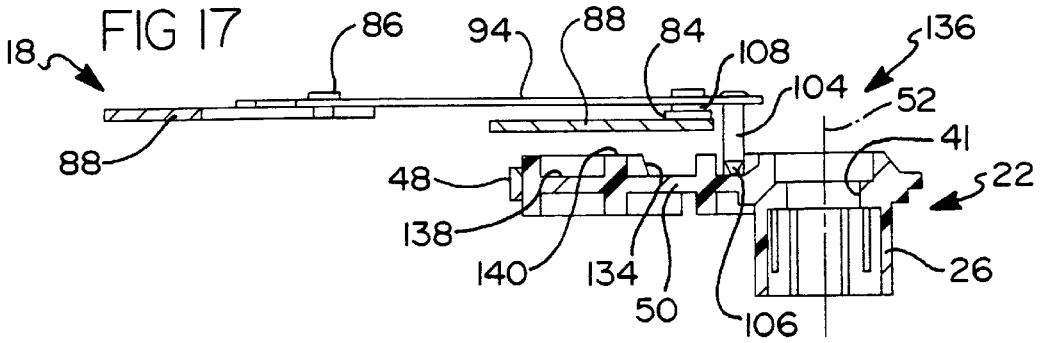
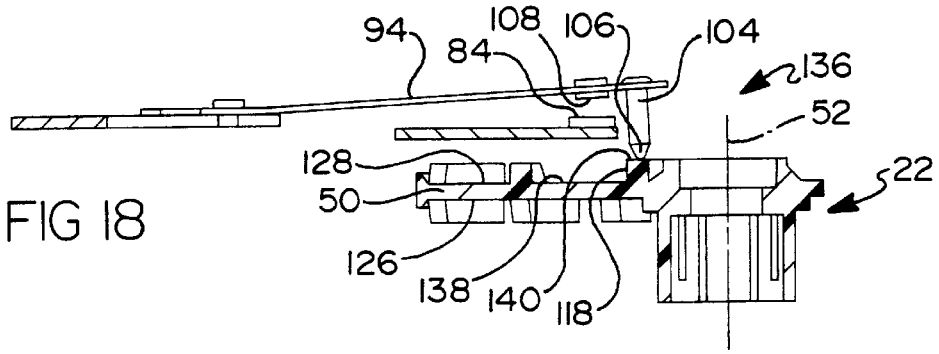
FIG 18
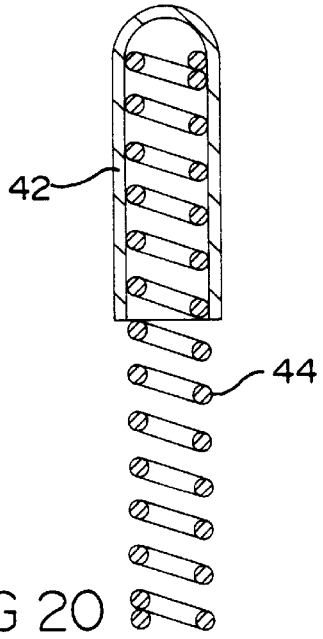
FIG 20
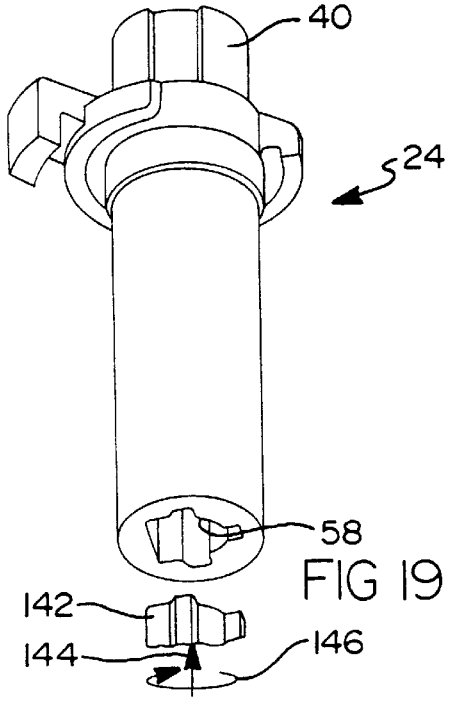
FIG 19

IGNITION SWITCH WITH SEGMENTED ROTARY ACTUATION FOR CONSTRAINED PACKAGING ENVIRONMENT

FIELD OF THE INVENTION

The present invention relates to an electrical ignition switch for motor vehicles located in a housing for rotatable movement between several switching positions.

BACKGROUND OF THE INVENTION

An electrical rotary switch of a type suitable for use in a road vehicle as a starter or ignition switch, was previously disclosed in published German Patent Application number 42 33 520. The electrical rotary switch disclosed in the published German Patent has a central spindle with cam elements that operate against moveable contact carriers. Each carrier is retained by a coil spring and pivots about a support plate. The carrier has contacts at the end and has projections that the cam engages. The center spindle has slots engaged by spring loaded indent elements to define the positions. This ignition switch is capable of controlling functions such as radio, charge monitoring lights, oil pressure, etc.

As the complexity of the modern automobile increases, the packaging of components within the total system has become increasingly problematic. Historically, in the layout process, when two components interfered with one another, one or both were simply relocated to avoid the necessity and cost of modifying or redesigning the components.

Certain subsystems of modern automobiles, such as steering column assemblies, however, require extremely high density component placement. Traditional component design strategies are no longer acceptable as center-to-center distances of components competing for the same real estate are reduced.

SUMMARY OF INVENTION

The present invention employs asymmetries in the design of an electrical switch which permit its placement in close proximity of other components. In the preferred application, an inventive ignition switch permits nested packaging with a multi-function stalk switch on an automobile steering column assembly and will be described in that context, it being understood that broadly taken, the present invention can be applied in varied alternative systems.

It is desirable in the present invention to reduce the overall dimensions of the ignition switch, enable automated assembly and reduce the cost of production. It is further desirable in the present invention to simplify the overall design of the ignition switch, while reducing the number of parts to be assembled with respect to one another and by incorporating previously external actuating members internally within the ignition switch housing, whereby the most complex and demanding manufacturing processes can be accomplished off-line, in advance of final assembly. In addition, it is desirable in the present invention to replace the spring biased bridges previously used with electrically conductive leaf springs. It is further desirable in the present invention to provide spring biased locking mechanisms to hold the switch housing in place when installed in the ignition switch casting. It is desirable in present invention to provide electrically conductive insert molded parts to further simplify assembly and to reduce costs. It has also been found desirable to use ultra-sonic welding at the stationary side or end of the electrically conductive leaf spring members to protect the leaf spring members from detrimental changes do to high temperature produce during soldering operations which may result in weak leaf springs. The weaker leaf springs are a consequence of excessive heating and detrimentally impact the resiliency or spring back tendency of the electrically conductive leaf spring members. It has further been found desirable to make the electrically conductive leaf spring members of beryllium copper (BeCu) material.

The present invention overcomes many of the short comings of the prior art by providing an electrical switch which can be employed to selectively control the ignition circuit of a motor vehicle and includes a housing which carries at least a pair of electrical contacts, a sector-shaped actuator which is disposed for limited rotation about an axis which extends normally through the origin of the sector-shaped actuator and defining an axially extending cam surface thereon. A cam follower is disposed for slidingly engaging a cam surface for displacement in response to rotation of the actuator to affect selective opening and closing of the electrical contacts. This arrangement has the advantage of providing a rotary cam operator type switch which is, of necessity, packaged very close to an obstructing structure. The present invention provides an ignition switch approximately half the size of previously know ignition switches and provides a drive for the actuator which is substantially fully encased within and protected by the switch housing. By reducing the number of elements, the present invention eliminates tolerance built-ups that can lead to unsatisfactory operation of ignition switches. The present invention desirably replaces three previously used parts, namely, the lobe follower, hinge point and compression spring, with a single electrically conductive leaf spring member for each switched circuit. Furthermore, it is desirable in the present invention to provide an ignition switch that can be assembled from one side starting from the front cover with subsequent parts installed layer by layer until rear cover is assembled.

The present invention discloses an electrical switch including housing means having a wall for supporting a first electrical contact. Rotatable means is connected to the housing means for rotation about a pivot axis extending generally normal to the first wall. The rotatable means includes a radially extending wall opposing the first wall of the housing. The radially extending wall is sector-shaped and has at least one arcuate concentric cam surface sector opposing the first wall. Cam follower means carried by the free cantilever end of the electrically conductive leaf springs extend through the first wall and contact the cam surfaces for selectively opening and closing an electrical circuit by allowing selective electrical engagement of the leaf spring with at least one contact in response to rotational movement of the rotatable means. In the preferred configuration, the electrical switch according to the present invention provides for movement between at least four positions including an off position, a start position, a run position and accessory position. Preferably, the ignition switch according to the present invention provides for switching both low current and high current connections selectively based on the position of the ignition switch.

Other objects, advantages and applications for the present invention will become apparent to those skilled in the art when the following description of the best mode contemplated for practicing the invention is read in conjunction with the accompanying drawings.

BRIEF DESCRIPTIONS OF THE DRAWINGS

The description herein makes reference to the accompanying drawings wherein like reference numerals refer to like parts throughout the several views, and wherein:

FIG. 3, is a top plan view of the four leaf housing assembly of FIG. 2;

FIG. 4, is a bottom plan view of the four leaf housing assembly of FIG. 2;

FIG. 5, is a side plan view of the four leaf housing assembly of FIG. 2;

FIG. 17, illustrates, in cross-section a typical switch element including conductive leaf spring, contacts and associated conductive buses juxtaposed with the switch timing cam with contacts in the "closed" condition;

FIG. 18, illustrates the switch of FIG. 17, with the contacts with the "open" condition;

FIG. 19, is a perspective view of a drive shaft for the switch timing cam of the ignition switch illustrating in exploded view of FIG. 1;

FIG. 20, is a cross-sectional view of a detent plunger assembly of the ignition switch illustrated in exploded view in FIG. 1;

DETAILED DESCRIPTION OF THE PREFERED EMBODIMENT

The present invention relates to an electrical rotary switch, generally designated as 10, particularly for use as an ignition switch in vehicles for controlling the starting, ignition and accessory functions. Switch 10 provides an automotive designer with packaging alternatives as contrasted with external gear driven type rotary switches such as that described in U.S. Pat. No. 5,596,180. Although having a number of fundamental design differences from the switch described in U.S. Pat. No. 5,596,180, switch 10 of the present invention has adopted a number of internal features similar in certain respects to corresponding features described in U.S. Pat. No. 5,596,180. Accordingly, a complete understanding of internal structural details an operation of the present invention is enhanced by previewing U.S. Pat. No. 5,596,180. For that reason, the specification of U.S. Pat. No. 5,596,180 is incorporated herein by reference.

Figure 1:
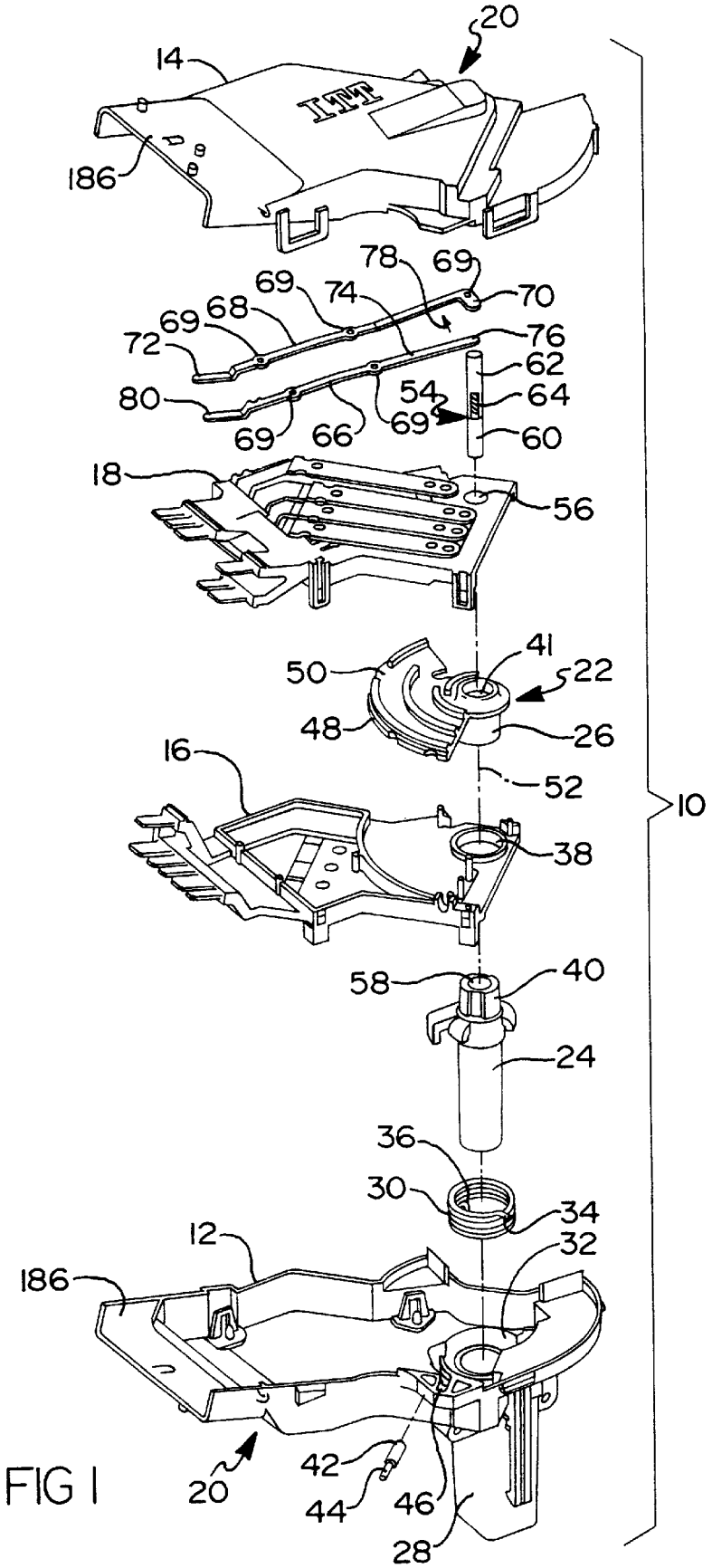
FIG. 1, is an exploded view of an ignition switch according to the present invention.
Figure 2:
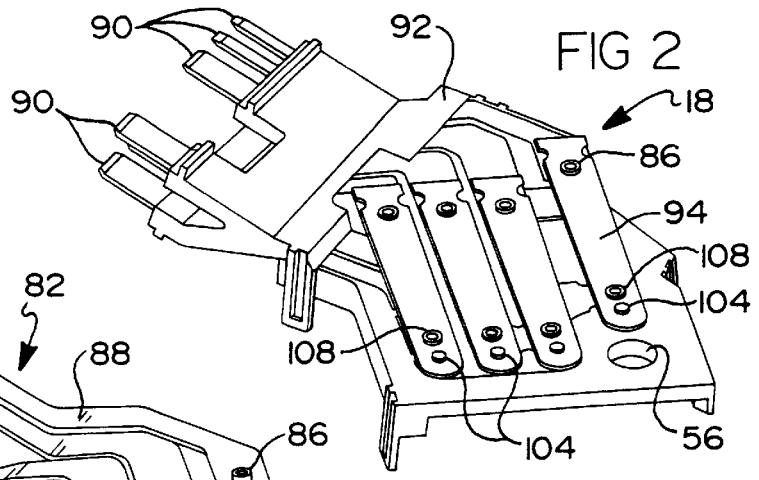
FIG. 2, is a perspective view of a four leaf housing assembly from the ignition switch illustrated in the exploded view of FIG. 1.

Referring to FIG. 1, the electrical rotary switch 10 according to the present invention includes a first or front cover 12 and a second or rear cover 14 co-acting to enclose the remaining components of switch 10. The internal components of switch 10 are arranged to facilitate serial axial assembly in a process similar to that described in U.S. Pat. No. 5,596,180. Final assembly of switch 10 is accomplished by fastenerless connection of front and rear covers 12 and 14 by a system of self-engaging snaps and tabs.

First and second leaf spring switch sub-assemblies 16 and 18, respectively, are disposed within a cover assembly 20 comprising of first and second covers 12 and 14, respectively. A rotary, segmented timing cam or actuator 22 is disposed axially intermediate first switch sub-assembly 16 and second switch sub-assembly 18 for limited rotation with respect thereto. A cam drive shaft 24 drively engages a hub 26 of timing cam 24 for rotation therewith and extends downwardly, as illustrated in FIG. 1, through a protective housing extension 28 integrally formed in front cover 12. The lower most end of housing extension 28 is open to receive a driven member (illustrated in FIG. 19) controlled by the key lock set of the host vehicle ignition system.

A torsion spring 30 is disposed within a recess 32 formed in housing extension 28. Spring 30 serves to rotationally biased shaft 24 and timing cam 22 from a position corresponding with the "start" mode of operation to a position corresponding with an "on" or "run" mode of operation. A first end 34 of spring 30 engages cover 12 within recess 32 and a second end 36 of spring 30 engages drive shaft 24.

When switch 10 is fully assembled, sub-assembly 16 is snap fit within front cover 12 to retain spring 30 within recess 32. Drive shaft 24 extends upwardly through an opening 38 formed in sub-assembly 16 and is dimensioned such that shaft 24 is free to rotate with respect to sub-assembly 16 with opening 38 providing bearing support to drive shaft 24. The uppermost end 40 of drive shaft 24 is keyed to engage an opening 41 extending through hub 26 of rotary cam 22 to provide a rigid interconnection there between whereby cam 22 and drive shaft 24 rotate as a single unit with respect to cover assembly 20. A detent plunger 42 and biasing spring 44 are disposed within a radially inwardly opening recess 46 formed in front cover 12 whereby the radially inward most end of plunger 42 is in continuous engagement with the radially outermost circumferential surface 48 of the cam sector portion 50 of timing cam 22 to define rotational detent positions of cam 22 with respect to cover assembly 20 corresponding with the various ignition system functional modes.

Second switch sub-assembly 18 is snap fit to first switch sub-assembly 16, both rigidly retained within cover assembly 20, to entrap rotary cam 22 therebetween while allowing limited relative rotation about axis 52.

A key switch plunger assembly 54 is slidably received within an opening 56 formed in second sub-assembly 18 positioned concentrically with passageway 41 of timing cam 22 and through passage 58 of drive shaft 24. Key plunger assembly 54 comprises a base portion 60 axially slidably engaging a plunger portion 62 and an intermediate biasing spring 64 which tends to continuously separate base portion 60 and plunger portion 62. Plunger assembly 54 extends into through passage 58 of drive shaft 24 to ensure that the lower most end of base portion 60 engages the mechanical key lock drive mechanism of the host vehicle ignition system. Two conductive bus members 68 and 70 are permanently insulatively attached at anchor points 69 to the under side of rear cover 14 in a generally parallel spaced relationship. One end of bus member 68 has an enlarged contact area 70 which, upon assembly, intersects axis 52. The opposite end of bus member 68 forms a terminal 72 adapted for interconnection with a host vehicle electrical system. One end of bus member 66 likewise terminates in a position intersecting axis 52 but spaced axially slightly away from contact area 70. The end of bus member 66 extending rightwardly from the righthandmost anchor point 69 functions as a moving contact as part of a cantilever arm portion 74 of bus member 66 as indicated by arrow 78. The opposite end of bus member 66 forms a terminal 80 which, in application, is in-circuit with the host vehicle ignition system.

Buses 66 and 68 and their respective contacts 76 and 70, in the preferred application of the present invention, provide a "key-in" switching function, whereby when a valid ignition key is inserted into the host vehicle ignition lock set, the end of the key axially displaces an ignition switch engagement element which axially pushes upwardly on base portion 60 of key plunger 54. In turn, plunger portion 62 presses upwardly against moving contact 76, moving into abutting relationship with fixed contact area 70. This action closes the electrical circuit between bus members 66 and 70 and provides a switching function for electrically actuating a buzzer or other suitable warning device.

FIGS. 2 through 6 collectively illustrate the structural details of second leaf spring switch sub-assembly 18. Sub-assembly 18 functions as a housing for supporting one or more cam operated leaf spring types switches as will be described in detail herein below. In the preferred embodiment, switch sub-assembly 18 provides four discreet cam operated electrical switches. Inasmuch as each of the switches are substantially similar in structure and operation, the operation of a single typical switch will be described in detail herein below.

Figure 6:
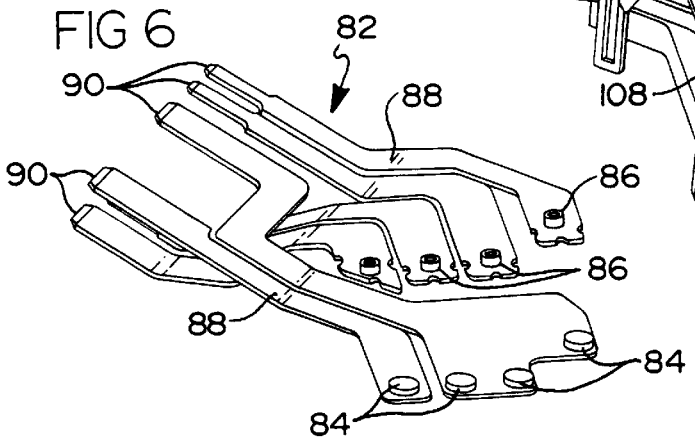
FIG. 6, is a perspective view of nested buses which are insert molded within the four leaf housing assembly of FIG. 2.

Switch sub-assembly 18 is constructed by first forming a group of nested conductive buses which are preferably formed from a single stamping operation and die-formed to provide various electrically conductive paths within the switch sub-assembly 18. As best seen in FIG. 6, the nested buses shown generally 82 are preformed and positioned with respect to one another after having fixed electrical contacts 84 and leaf spring locating studs 86 formed at appropriate locations thereon. Typically, contacts 84 and studs 86 are disposed adjacent one end of each bus or conductor 88. However, this is subject to great variation depending upon the number of switches to be including in the circuit, the current carrying capacity or requirements of each of the switches and the like. The opposite ends of each bus or conductor typically terminates in a terminal 90 adapted for electrically interfacing with the host vehicle ignition circuit.

Nested buses 82 are then insert molded within a base portion 92 of the switch sub-assembly 18 in such a manner as to leave terminals 90, fixed contacts 84 and locating studs 86 exposed. Base portion 92, as well as covers 12 and 14, are preferably injection molded of electrically insulative material such as plastic. Electrically conductive leaf spring means are then attached to sub-assembly 18. Each leaf spring means or member is preferably constructed of electrically conductive, resiliently flexible material. A metallic material such as beryllium copper (BeCu) has been found suitable for switching electrical loads typically employed in automotive applications. Busses 66, 68 and 88 are formed of copper or other suitable electrically conductive material.

Figure 21:
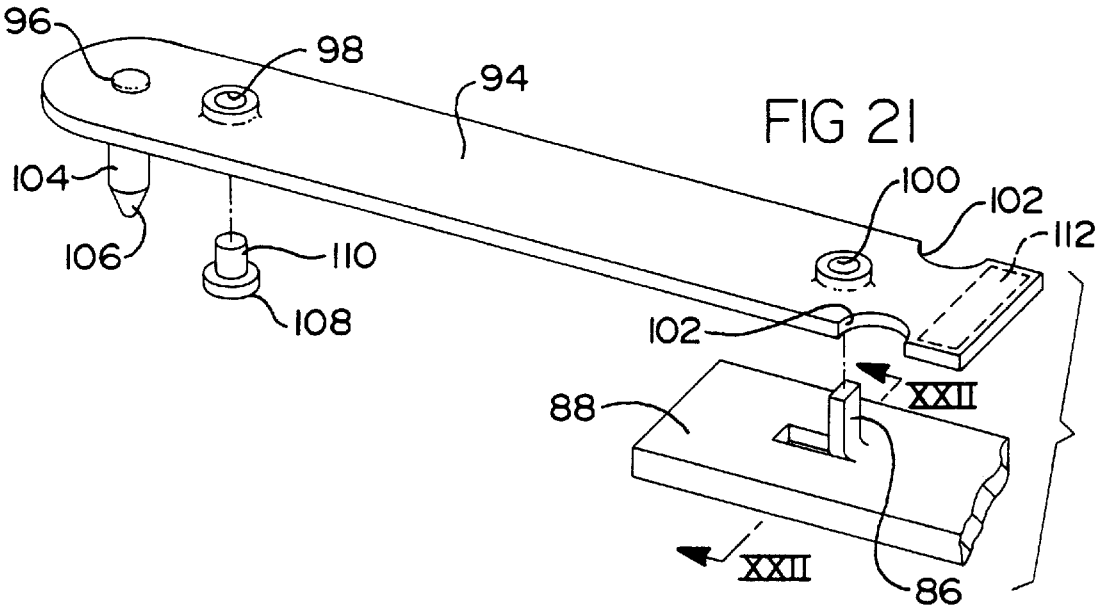
FIG. 21, is a perspective exploded view on an enlarged scale of the details of a typical conductive leaf spring and an associated base bus.
Figure 22:
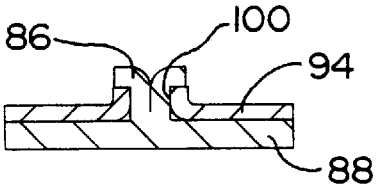
FIG. 22, is a cross-sectional view taken on line XXII—XXII of FIG. 21.

As best seen in FIGS. 21 and 22, the attachment of a typical electrically leaf spring 94 is illustrated. Prior to attachment of leaf spring 94 to an associated bus 88, leaf spring 94 has through passages 96 and 98 formed at one end thereof and a third through passage 100 formed adjacent the opposite end thereof . In the preferred embodiment, laterally opposed recesses 102 are formed in the sides of leaf spring 94 adjacent through passage 100. An elongated pin 104 has an area of reduced diameter at one end thereof which is positioned within through passage 96 and swedged, deformed or otherwise mechanically attached to the end of conductive leaf spring 94. The opposite end of pin 104 is contour 106 to act as a cam follower as will be described in detail hereinbelow. A moving contact 108 of highly conductive material such as silver has a stud 110 formed therein which is positioned within through passage 98 in which is subsequently deformed or welded into permanent assembly with conductive leaf spring 94 as is well known in the switch art. When leaf spring 94 is to be attached to its corresponding bus or conductor 88, it is prepositioned whereby the locating stud 86 extends through passage 100. Prior to being permanently attached to bus 88, leaf spring 84 can be precisely positioned by manipulators which grasp recesses 102 and precisely positioning leaf spring 94 such that moving contact 108 is concentrically disposed with its mating fixed contact 84. Once this is accomplished, locating studs 86 can be mechanically deformed as best shown in FIG. 22 to permanently attach leaf spring 94 to bus 88. Lastly, the end of leaf spring 94 most distant moving contact 108 can be welded to bus 88 to ensure redundant positive connection with little chance of the thermal shock due to the welding process creating a misalignment of moving contact 108 with its mating fixed contact 84. The preferred region for welding is designated at 112 in FIG. 21.

As best seen in FIGS. 3 through 5, when the second sub-assembly 18 is fully assembled, each conductive leaf spring 94 is mechanically fastened at one end to a bus 88 and cantilevered therefrom to resiliently bias its moving contact 108 against a mating fixed contact 84.

Base portion 92 defines a generally planar wall 116 in the area thereof which will be disposed proximate and facing timing cam 22. Openings 114 are providing in wall 116 through which cam followers or contours 106 project. Wall 16 generally normal to axis 52.

Referring to FIGS. 12 to 16, the details of the rotary segmented timing cam 22 are illustrated. As in the case of front and rear covers 12 and 24, base portion 92 of switch sub-assembly 18, cam drive shaft 24, and key plunger assembly 54, timing cam 22 preferably formed of injection molded thermal plastic or other suitable material.

The cam sector portion 50 of timing cam 22 is generally plainer and disposed normal to axis 52. Thus, as cam 22 is rotated between its limits of travel, the axial spacing between sector portion 50 and wall 116 of switch sub-assembly 18 remains fixed. A plurality of radially spaced concentric cam surfaces 118, 120, 122 and 124 extend axially from the side of sector portion 50 facing or opposing switch sub-assembly 18. Each cam surface 118 through 124, is position at a fixed constant radius from the axis 52, designated R1–R4, respectively, in FIG. 24, which correspond with the nominal radial spacing of the contoured end 106 of the cam follower 104 of the conductive leaf spring 94 associated with that particular cam surface.

Sector portion 50 defines a first wall or side 126 facing the first leaf spring switch sub-assembly 16 and a second wall or side 128 facing the second leaf spring switch leaf spring sub-assembly 18. The cam surfaces 118, 120, 122 and 124 extend axially from the second side 128 of sector portion 50 circumferentially extending about a portion of cam sector portion 50. In the preferred embodiment of the invention, the cam sector portion 50 extends 135°. As defined by the angular offset of two radial edges 130 and 132 interconnecting at their radially outward most points by circumferential surface or edge 48. Edges 130 and 132 extend substantially directly radially outwardly from the axis of rotation 52. Restated, in the preferred embodiment, radii drawn along edges 130 and 132 will intersect axis 52. Although 135° sector was selected for the present preferred embodiment, it is to be kept in mind that the included angle between edges 130 and 132 could be oblique, obtuse, acute, or a right angle without departing from the spirit of the present invention.

Each surface 118, 120, 122 and 124 has interruptions formed therein where it transitions from an upper longitudinally outward surface 140 to a lower longitudinally inward surface 138 or lower surface corresponding with second wall side 128. Each cam surface 118, 120, 122 and 124 defines ramp portion 134 at the points of transition between the upper and lower surfaces 140 and 138.

Referring to FIGS. 17 and 18, the operation of a single electrically conductive leaf spring switch 136 as employed in the present application is illustrated. To aid in the understanding of the operation of timing cam 22 with respect to a typical switch 136, FIGS. 17 and 18 have been simplified to illustrate a portion of the second switch sub-assembly 18 juxtaposed with the timing cam 22. FIG. 17 illustrates switch 136 in the "closed" condition in which contacts 84 and 108 are physically abutting one another to establish a path of electrical conduction from the left hand most bus 88, through leaf spring 94, contacts 108 and 84 and right hand most bus 88. To visualize the operation of switch 136, understand that both buses 88 are relatively fixed while timing cam 22 rotates about axis 52. As illustrated in FIG. 17, timing cam 22 has been rotated so that the contoured end 106 of cam follower 104 is in line-to-line contact or just slightly spaced from the lower surface 138 of the second wall or side 128 of cam sector portion 50. The natural resiliency of leaf spring 94 will bias or urge moving contact 108 downwardly and maintain it in intimate contact with fixed contact 84. In this condition, switch 136 is "closed".

As timing cam 22 is rotating about axis 52, contoured end 106 of cam follower 104 will remain in its slightly spaced condition with respect to longitudinally inward surface 138. As timing cam 22 continues to rotate, contoured end 106 of cam follower 104 will contact a ramp portion 134 (see FIG. 14) of cam surface 118. As the timing cam 22 continues to rotate, the ramp portion 134 will press upwardly on cam follower 104, bending leaf spring 94 counter-clockwise toward the position illustrated in FIG. 18. Ultimately, the contoured end of 106 of cam follower 104 will be elevated to the upper longitudinal inward surface 140 of cam surface 118. During this transition, moveable contact 108 is displaced from fixed contact 84. In this condition, the associated switch 136 is in the "open" position in which the flow of electrical energy through switch 136 is interrupted. This operation is typical for switches 136 associated with cam surfaces 120, 122 and 124.

Referring to FIG. 19, in application, a keyed drive member 142 is slip-fit within through passage 58 of drive shaft 24. When drive member 142 is disposed within through passage 58, drive member 142, drive shaft 24 and timing cam 22 all rotate in unison. Furthermore, drive member 142 is free to slidably move within passage way 58 when a valid key is inserted within the associated ignition lock. This axial movement, is illustrated by arrow 144 and results in drive member 142 contacting the key plunger assembly 54 to close the key-in switch terminals 76 and 70. Rotation of drive member 142, as illustrated by arrow 146, will selectively rotate timing cam 22 between its two limits of travel and specifically between its various detented set positions of "accessory", "off", "ignition" and "start". Recesses 148, 150, 152 and 154 are formed in circumferential surface 48 of sector portion 50 to establish detents and/or stops corresponding with each of the associated circuit conditions.

FIG. 20, illustrates the details of the tubular closed end detent plunger 42 with one end of biasing spring 44 inserted therein. The free end of the biasing spring 44 is inserted within recess 46 of front cover 12.

Figure 7:
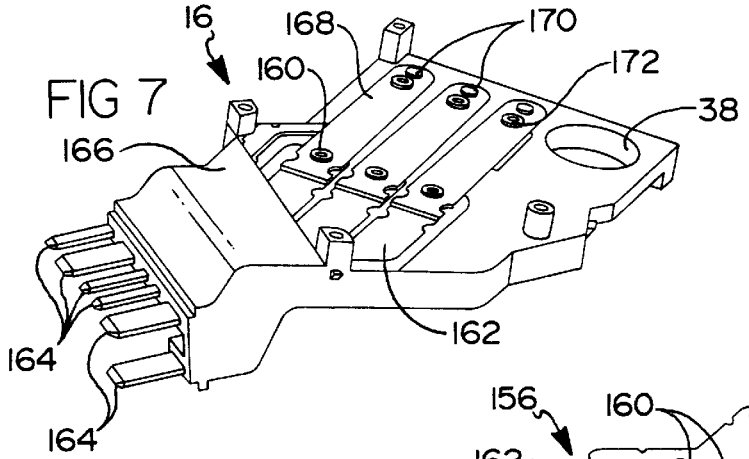
FIG. 7, is a perspective view of a three leaf housing assembly from the ignition switch illustrated in the exploded view of FIG. 1.
Figure 11:
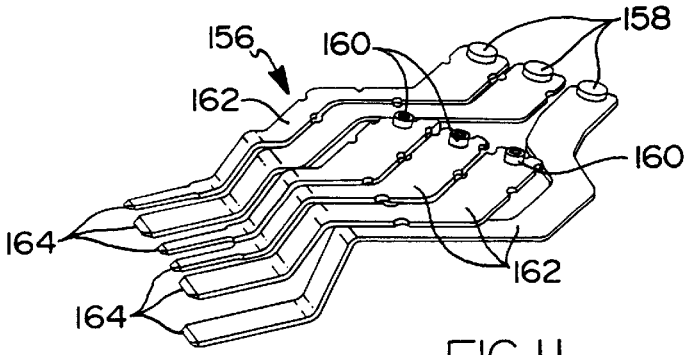
FIG. 11, is a perspective view of nested buses which are insert molded within the three leaf housing assembly of FIG. 7.
Figure 8:
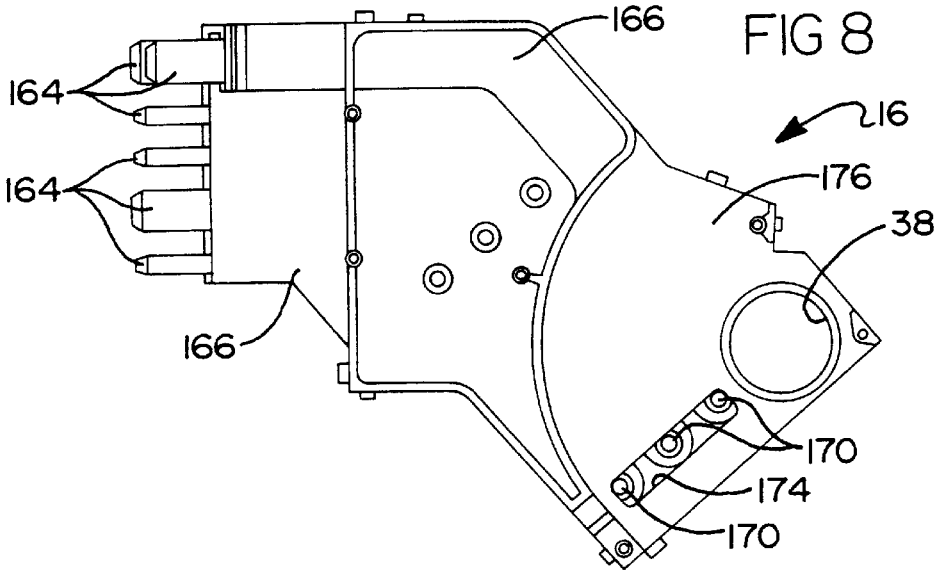
FIG. 8, is a top plan view of the three leaf housing assembly of FIG. 7.
Figure 10:
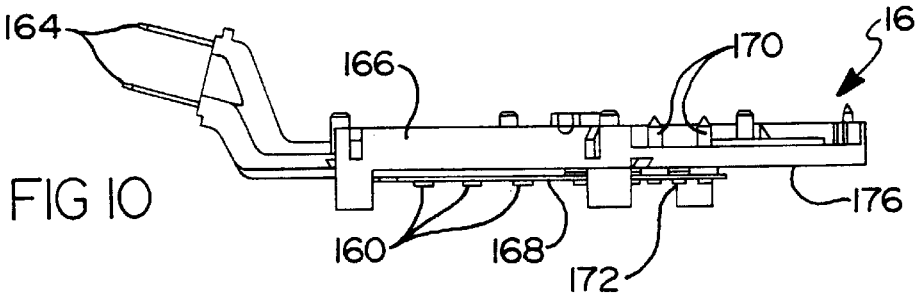
FIG. 10, is a side plan view three leaf housing assembly of FIG. 7.
Figure 9:
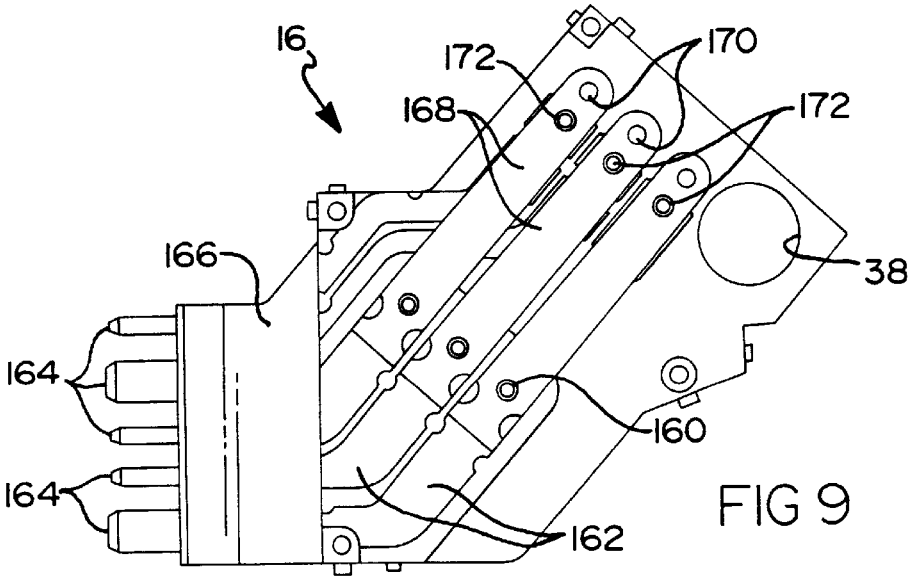
FIG. 9, is a bottom plan view of the three leaf housing assembly of FIG. 7.
Figure 14:
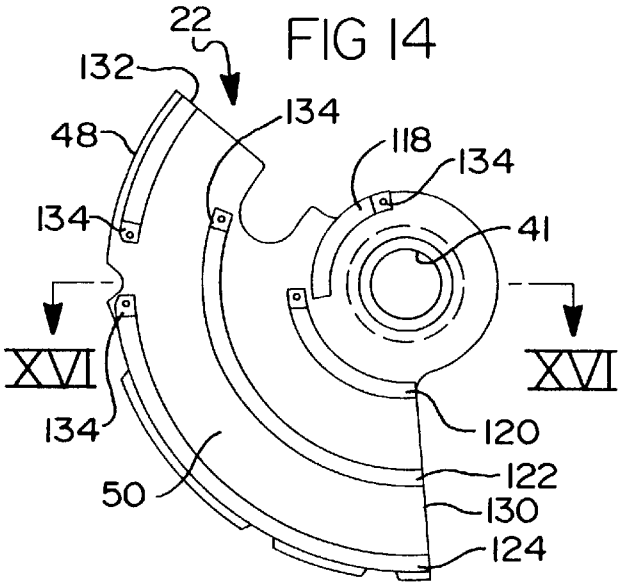
FIG. 14, is a top plan view of the switch timing cam of FIG. 12.
Figure 16:
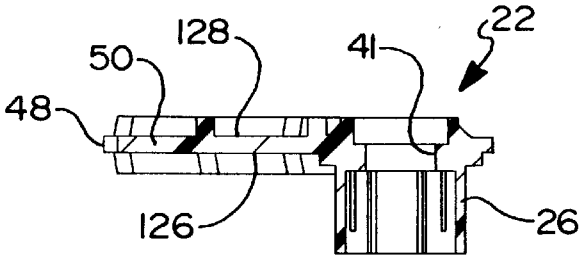
FIG. 16, is a cross-sectional view of the switch timing cam taken on lines XVI—XVI of FIG. 14.
Figure 15:
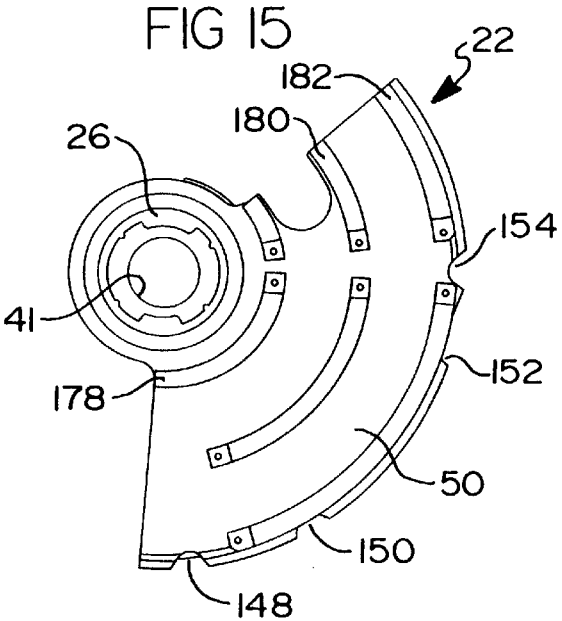
FIG. 15, is a bottom plan view of the switch timing cam of FIG. 12.
Figure 12:
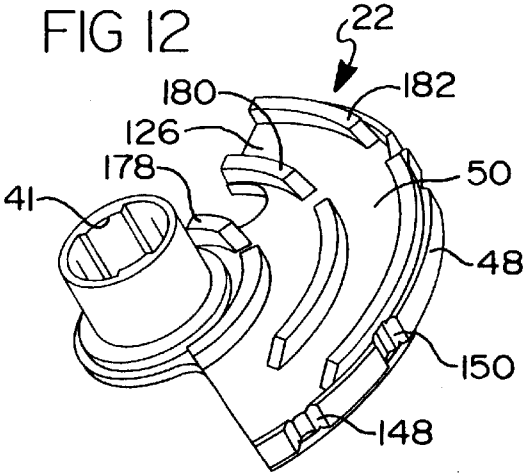
FIG. 12, is a perspective view of the a switch timing cam from the ignition switch illustrated in the exploded view of FIG. 1.
Figure 13:
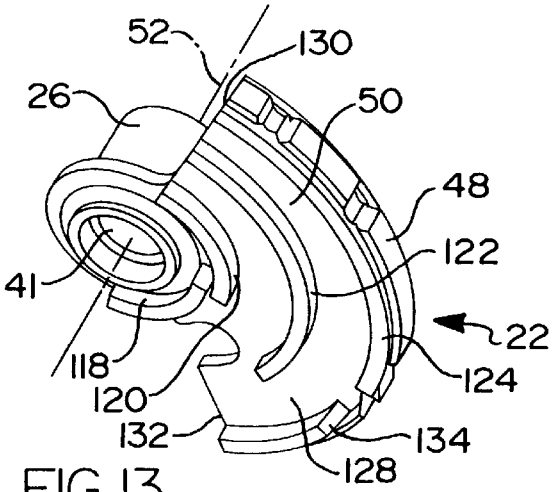
FIG. 13, is an alternative perspective view of the switch timing cam of FIG. 12.

Referring to FIGS. 7 through 11, the structural details of the first leaf spring switch sub-assembly 16 are illustrated. In many ways, switch sub-assembly 16 is a mirror image of switch sub-assembly 18 as described herein above consisting of nested buses 156 preassembled with fixed contacts 158 and locating studs 160 affixed to individual buses or conductors 162 which terminate in terminals 164. Nested buses 156 are insert molded into a base portion 166 to provide for fixed mounting of fixed contacts 158 as illustrated in FIG. 7. Electrically conductive leaf springs 168 are connected at one end to their respective bus 162 as described herein above and extend in cantilever fashion therefrom. The free end of leaf springs 168 support a cam follower 170 and a moving contact 172. Cam followers 170 extend through an opening 174 in a generally planner wall portion 176 of base portion 166 which is disposed substantial normally to axis 52. The switches formed on switch assembly 16 operate as described herein above with respect to the switches 136 of sub-assembly 18. Referring to FIGS. 12 and 15, first side 126 of cam sector portion 50 is generally plainer and disposed normally to axis 52. Three radially spaced cam surfaces 178, 180 and 182 are concentrically arranged on surface 126 to selectively engage their respective cam followers 170 upon rotation of timing cam 22.

Figure 23:
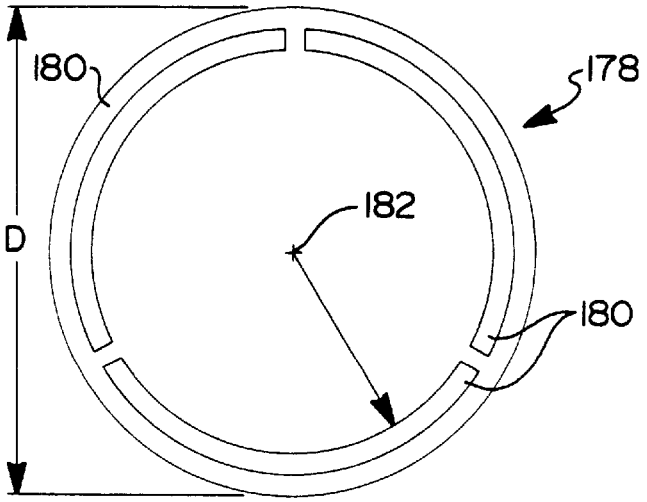
FIG 23 PRIOR ART
FIG. 23, is a plan view of a simplified prior art rotary switch timing cam.

Referring to FIG. 23, a schematic view of a typical prior art switch timing cam 179 is illustrated with a series of constant radius cam surfaces 181 circumferentially arranged about the outer perimeter of cam 179 for rotation about axis 183. Although acceptable in some applications, this arrangement does not lend itself to tight packaging situations where center-to-center dimensions of rotating parts has been minimized. The prior art timing cam of 179 in all cases requires at least ½ D spacing from the nearest adjacent object. Furthermore, the aggregate circumferential extent of the swept cam surfaces 181 is 360°.

Figure 24:
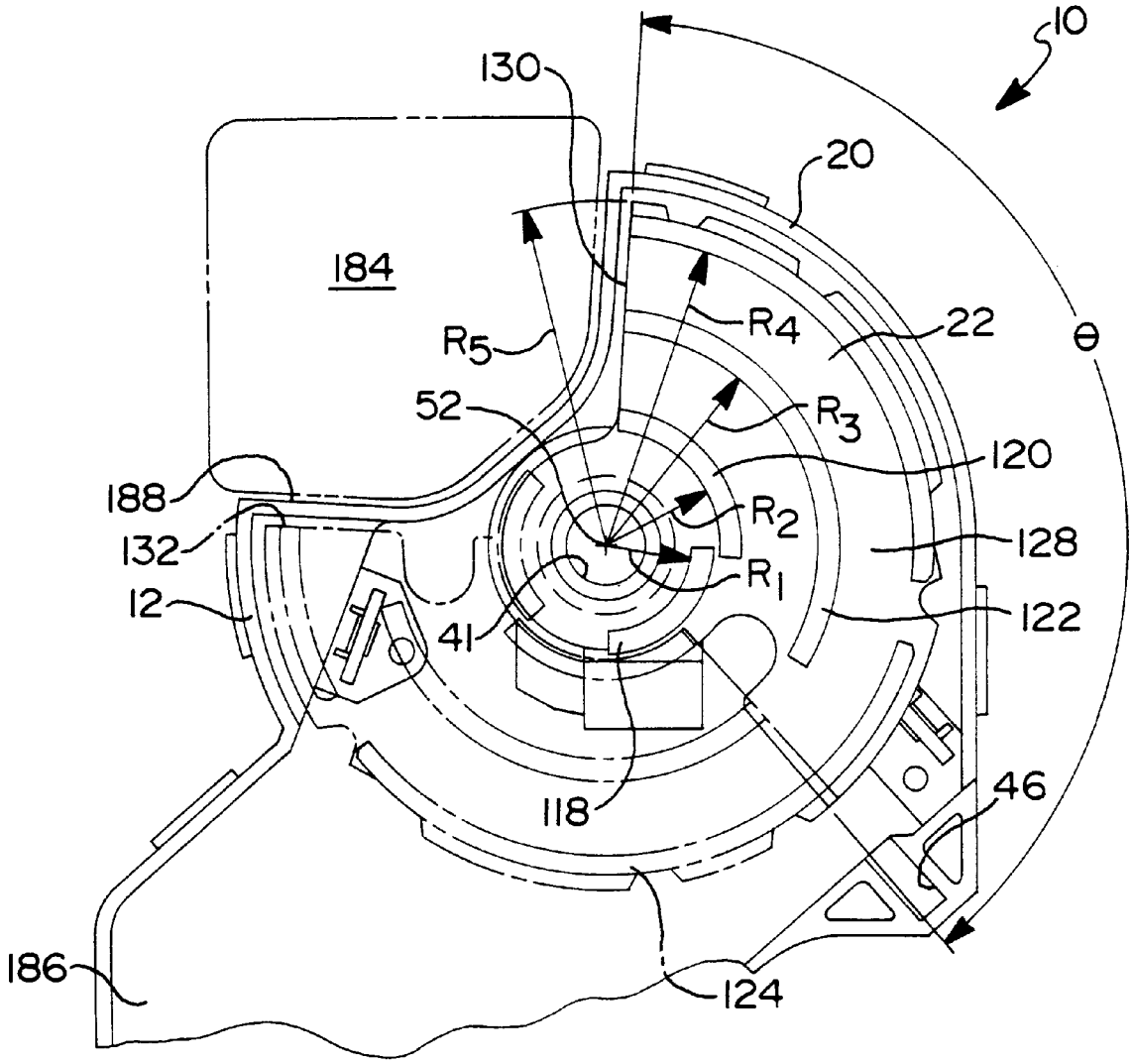
FIG. 24, is a plan view of the switch timing cam disposed within the front cover from the ignition switch illustrated in the exploded view of FIG. 1, illustrating the range of motion of the switch timing cam.

Referring to FIG. 24, a significant advantage of the present invention is illustrated in a plan view in which timing cam 22 is disposed within front cover 12. Timing cam 22 is illustrated in one (counter clockwise) limit of travel and in phantom in its opposite (clockwise) limit of travel. This arrangement permits removal of a full 90° sector 188 from the cover assembly 20 permitting extremely close packaging proximity of switch 10 with an adjacent object 184 while permitting a full range or sweep 135° sector timing cam 22 to pass in sliding engagement over the cam followers. With this arrangement, spacing between switch 10 and an object 184 can be reduced by as much as ⅔. Furthermore, depending upon the number of cam surfaces provided, an aggregate swept surface can substantially exceed 360°.

A further advantage is derived from a radial alignment of cam followers 104, the parallel positioning of leaf springs 94 and 168 and an angularly offset snout 186 of cover assembly 20 which further enhances a compact design. The snout 186 serves to protect terminals 72, 80, 90 and 164 which are positioned to mate with one or more ganged connectors having an insulator which snap-locks on the outer surface of snout 186.

More or fewer switch assemblies can be included without departing from the spirit of the present invention. It is to be understood, therefore, that the invention has been described with reference to specific embodiments and variations to provide the features and advantages previously described in that the embodiments are susceptible to modification as will be apparent of those skilled in the art. Accordingly, the foregoing is not to be construed in a limiting sense.

The invention has been described in an illustrative manner, and it is to be understood that the terminology which has been used as intending to be in the nature of words of description rather than limitation. Obviously, many modifications and variants of the present invention are possible in light of the above teachings. It is, therefore, to be understood that within the scope of the appended claims wherein reference numerals are merely for convenience and not to be limited, the invention maybe practiced otherwise than as specifically described.

What is claimed:

1. An electrical switch for selectively controlling an ignition circuit of a motor vehicle comprising:

housing means having a first wall for supporting at least one electrical contact;

rotatable means connected to said housing means for limited angular rotating movement about a pivot axis extending generally normal to said first wall, said rotatable means including a radially extending sector-shaped wall opposing said first wall of said housing, said radially extending sector-shaped wall extending less than 360° and having a plurality of radially spaced concentric cam surfaces, first and second generally radially extending edges and an outer generally arcuate edge;

a radially inward extending recess formed in the housing and intersecting a plane of rotation of the sector-shaped wall between the first and second edges of the wall;

follower means disposed for slidably engaging one of said cam surfaces with a first end and for moving a second end corresponding to a contour of said one of said cam surfaces as said one of said cam surfaces moves with respect to said first end when said rotatable means is rotated between angular positions; and electrically conductive leaf spring means connected to said housing means for biasing said follower means toward said one of said cam surfaces and for selectively opening and closing an electrical circuit by allowing selective electrical engagement of the leaf spring means with said at least one contact in response to rotational movement of said rotatable means, said leaf spring means defining at least one switch operable between an open position and a closed position responsive to movement of said follower means as said rotatable means is rotated about said pivot axis.

2. The electrical switch of claim 1, wherein said radially extending edges are angularly offset at an oblique angle.

3. The electrical switch of claim 1, wherein said radially extending edges are angularly offset at an obtuse angle.

4. The electrical switch of claim 1, wherein said radially extending edges are angularly offset at an acute angle.

5. The electrical switch of claim 1, wherein said radially extending edges are angularly offset at a right angle.

6. The electrical switch of claim 1, wherein said outer arcuate edge is disposed concentrically with said cam surfaces.

7. The electrical switch of claim 1, further comprising means operative to bias said rotatable means in one rotational direction.

8. The electrical switch of claim 1, further comprising drive means operatively engaging said rotatable means for the rotation thereof.

9. The electrical switch of claim 1, wherein said leaf spring means comprises an elongated cantilevered leaf spring having a first end affixed to said housing means and a second opposed end contacting said follower means.

10. The electrical switch of claim 9, further comprising a second contact carried adjacent the second end of said leaf spring registering with said at least one electrical contact.

11. The electrical switch of claim 9, wherein said first end of said leaf spring is weldingly affixed to said housing means.

12. The electrical switch of claim 11, further comprising means operative to pre-position said leaf spring with respect to said housing means prior to welding thereof.

13. The electrical switch of claim 12, wherein said pre-positioning means comprises a locating stud extending from said housing means though an aperture in the first end of said leaf spring.

14. An electrical switch for selectively controlling an ignition circuit of a motor vehicle comprising:

housing means having a wall for supporting at least one electrical contact;

rotatable means connected to said housing means for limited angular rotating movement about a pivot axis extending generally normal to said first wall, said rotatable means including a radially extending sector-shaped wall opposing said first wall of said housing, said radially extending wall having a plurality of radially spaced concentric cam surfaces;

drive means operatively engaging said rotatable means for the rotation thereof, said drive means including an elongated drive shaft disposed concentrically with said pivot axis;

follower means disposed for slidably engaging one of said cam surfaces with a first end and for moving a second end corresponding to a contour of said one of said cam surfaces as said one of said cam surfaces moves with respect to said first end when said rotatable means is rotated between angular positions; and electrically conductive leaf spring means connected to said housing means for biasing said follower means toward said one of said cam surfaces and for selectively opening and closing an electrical circuit by allowing selective electrical engagement of the leaf spring means with said at least one contact in response to rotational movement of said rotatable means, said leaf spring means defining at least one switch operable between an open position and a closed position responsive to movement of said follower means as said rotatable means is rotated about said pivot axis.

15. The electrical switch of claim 14, wherein said elongated drive shaft has a first end drivingly attached to said rotatable means and a second end adapted for coupling with an input drive means.

16. The electrical switch of claim 15, wherein said housing substantially entirely encloses said elongated drive shaft.

17. The electrical switch of claim 15, further comprising at least one pair of auxiliary electrical contacts displaceable between closed and open positions in response to axial displacement of a plunger disposed concentrically with said elongated drive shaft.

18. An electrical switch for selectively controlling an ignition circuit of a motor vehicle comprising:

housing means having a wall for supporting at least one electrical contact;

rotatable means connected to said housing means for limited angular rotating movement about a pivot axis extending generally normal to said first wall, said rotatable means including a radially extending sector-shaped wall opposing said first wall of said housing, said radially extending wall having a plurality of radially spaced concentric cam surfaces;

follower means including a plunger fixedly attached to said leaf spring means and disposed for slidably engaging one of said cam surfaces with a first end and for moving a second end corresponding to a contour of said one of said cam surfaces as said one of said cam surfaces moves with respect to said first end when said rotatable means is rotated between angular positions; and electrically conductive leaf spring means connected to said housing means for biasing said follower means toward said one of said cam surfaces and for selectively opening and closing an electrical circuit by allowing selective electrical engagement of the leaf spring means with said at least one contact in response to rotational movement of said rotatable means, said leaf spring means defining at least one switch operable between an open position and a closed position responsive to movement of said follower means as said rotatable means is rotated about said pivot axis.

19. An electrical switch for selectively controlling an ignition circuit of a motor vehicle comprising:

housing means having a wall for supporting at least one electrical contact;

rotatable means connected to said housing means for limited angular rotating movement about a pivot axis extending generally normal to said first wall, said rotatable means including a radially extending sector-shaped wall opposing said first wall of said housing, said radially extending wall having a plurality of radially spaced concentric cam surfaces;

follower means disposed for slidably engaging one of said cam surfaces with a first end and for moving a second end corresponding to a contour of said one of said cam surfaces as said one of said cam surfaces moves with respect to said first end when said rotatable means is rotated between angular positions;

electrically conductive leaf spring means connected to said housing means for biasing said follower means toward said one of said cam surfaces and for selectively opening and closing an electrical circuit by allowing selective electrical engagement of the leaf spring means with said at least one contact in response to rotational movement of said rotatable means, said leaf spring means defining at least one switch operable between an open position and a closed position responsive to movement of said follower means as said rotatable means is rotated about said pivot axis;

said leaf spring means including an elongated cantilevered leaf spring having a first end weldingly affixed to said housing means and a second opposed end contacting said follower means;

a second contact carried adjacent the second end of said leaf spring and registering with said at least one electrical contact; and means operative to pre-position said leaf spring with respect to said housing means prior to welding thereof, said pre-positioning means including a locating stud extending from said housing means through an aperture in the first end of said leaf spring and configured for symmetrical lateral deformation about the line of elongation of said leaf spring to effect a redundant attachment of said leaf spring and housing means.

20. An electrical switch for selectively controlling an ignition circuit of a motor vehicle comprising:

housing means having a wall for supporting a plurality of electrical contacts;

rotatable means connected to said housing means for limited angular rotating movement about a pivot axis extending generally normal to said first wall, said rotatable means including a radially extending sector-shaped wall opposing said first wall of said housing, said radially extending wall having a plurality of radially spaced concentric cam surfaces, first and second generally radially extending edges and an outer generally arcuate edge;

a plurality of followers, at least one follower disposed for slidingly engaging each of said cam surfaces with a first end and for moving a second end corresponding to a contour of its associated cam surface as said associated cam surface moves with respect to said first end when said rotatable means is rotated between angular positions; and a plurality of electrically conductive leaf springs, each connected to said housing means for biasing an associated follower towards said cam surface and for selectively opening and closing an electrical circuit by allowing selective electrical engagement of said leaf spring with an associated contact in response to rotational movement of said rotatable means, each said leaf spring defining a switch operable between an open position and a closed position responsive to movement of an associated follower as said rotatable means is rotated about said pivot axis.

21. An electrical switch for selectively controlling an ignition circuit of a motor vehicle comprising:

housing means carrying at least one pair of electrical contacts;

a radially inwardly extending recess formed in said housing means;

a sector-shaped actuator disposed for limited rotation about an axis extending normally through the origin thereof and defining at least one axially extending cam surface;

said recess intersecting a plane of rotation of said actuator and circumferentially opposed therefrom; and a cam follower disposed for slidably engaging said cam surface for displacement in response to rotation of said actuator to effect selective opening and closing of said electrical contacts.

22. The electrical switch of claim 21, wherein said recess defines a generally 90° sector.

* * * * *